US006553206B2

(12) United States Patent
Asuwa et al.

(10) Patent No.: US 6,553,206 B2
(45) Date of Patent: Apr. 22, 2003

(54) IMAGE FORMING APPARATUS

(75) Inventors: Kenji Asuwa, Toride (JP); Kazutaka Sato, Kashiwa (JP); Shigeru Obata, Ishioka (JP); Yasushi Kinoshita, Toride (JP); Akitomo Kuwabara, Hitachinaka (JP); Tetsuya Ooba, Hitachinaka (JP)

(73) Assignees: Hitachi, Ltd., Tokyo (JP); Hitachi Printing Solutions, Ltd., Kanagawa-ken (JP)

( * ) Notice: Subject to any disclaimer, the term of this patent is extended or adjusted under 35 U.S.C. 154(b) by 0 days.

(21) Appl. No.: 09/996,993

(22) Filed: Nov. 30, 2001

(65) Prior Publication Data

US 2002/0106228 A1 Aug. 8, 2002

(30) Foreign Application Priority Data

Feb. 8, 2001 (JP) ..... 2001-031690

(51) Int. Cl.[7] ..... G03G 15/00; B41F 5/04

(52) U.S. Cl. ..... 399/384; 399/301; 399/394

(58) Field of Search ..... 399/384, 394, 399/396, 301, 15, 51, 66; 271/256.01, 256.02

(56) References Cited

U.S. PATENT DOCUMENTS 5,040,026 A * 8/1991 Jamzadeh et al. ..... 399/301
5,701,573 A * 12/1997 Yoshiuchi et al. ..... 399/384
5,893,021 A * 4/1999 Yanashima ..... 399/384 X
6,188,418 B1 * 2/2001 Hata ..... 399/301 X

* cited by examiner

*Primary Examiner*—Sophia S. Chen
(74) *Attorney, Agent, or Firm*—Antonelli, Terry, Stout & Kraus, LLP

(57) ABSTRACT

An image forming apparatus is provided in which a misregistration of an image forming-position due to a tension, acting on a continuous recording medium, and a fluctuation thereof, is corrected with a low-cost construction to provide an image of high quality. A pair of recording medium speed detection devices are provided upstream and downstream of an image forming section, respectively, and a misregistration correction amount is calculated from a detected recording medium feed speed so as to correct the image forming position.

4 Claims, 3 Drawing Sheets

IMAGE FORMING APPARATUS

BACKGROUND OF THE INVENTION

1. Field of the Invention

This invention relates to an image forming apparatus.

2. Related Art

There have been extensively used image forming apparatuses of the type in which a latent image is formed on a surface of an image-carrying member, and a toner is caused to adhere to this latent image, thereby forming a toner image, and then this toner image is fixed to a recording medium.

In recent years, such an image forming apparatus has been advanced into a color version, and there has been an increasing demand for a high image quality and a high print speed. A variety of objects have now been printed, and therefore there has been a strong demand for the type of image forming apparatus capable of effecting high-speed printing on a continuous recording medium such as a paper roll or a plastic film.

In such an image forming apparatus, a color image is formed by superimposing toner images of different colors, that is, black (K), yellow (Y), magenta (M) and cyan (C), upon one another. For thus superimposing the toners of different colors on a continuous recording medium in high print speed, it is advantageous to use a so-called tandem-type apparatus in which a plurality of image forming units form toner images of different colors (K, Y, M and C), respectively, and these toner images are superimposed upon one another on the recording medium to thereby form a color image.

In the case of using the continuous recording medium, this recording medium is fed either by tractor paper feeder or by a roller paper feeder using rolls. In the roller paper feeder, the recording medium is grippingly held by rolls provided at front and rear portions of an image forming section, and a tension is applied to the recording medium by these rolls in order to stabilize the feeding operation.

In such an image forming apparatus, an elongation of the recording medium, produced by the applied tension, varies the speed of feed of the recording medium in the image forming section, so that misregistration of the superimposed toner images of different colors occurs in the direction of feed of the recording medium. The misregistration of the superimposed toner images adversely affects the image quality, and therefore some countermeasure must be taken.

However, the degree of elongation of the recording medium greatly varies from one material thereof to another. And besides, the tension, acting on the recording medium, varies during the operation of the apparatus, and therefore it is difficult to deal with this problem by beforehand adjusting the tension.

In order to deal with such problems, there has been proposed a method, as disclosed for example in JP-A-62-62764, in which registration marks are printed on a marginal portion of a recording medium, and the amount of misregistration is detected by reading this mark by the use of an optical sensor, and the printing position is corrected.

When the continuous recording medium is used in the conventional technique disclosed in the above JP-A-62-62764, those regions of this recording medium, on which the registration marks are printed, can not be used as an image forming region which is so originally intended, and this results in a problem that the recording medium is wasted. And besides, it is necessary to provide the high-precision optical sensor for reading the registration mark, and this is disadvantageous from the viewpoint of the cost.

SUMMARY OF THE INVENTION

It is an object of this invention to provide an image forming apparatus in which a position deviation of a recording medium can be detected highly precisely without the use of registration marks and a high-precision optical sensor.

This object can be achieved by an image forming apparatus according to the present invention, comprising:

a plurality of image forming units each comprising latent image-forming means for forming a latent image on an image-carrying member, developing means for causing a toner to adhere to the latent image, and transfer means for transferring the toner onto a continuous recording medium; and recording medium feed means for feeding the recording medium;

the toner images, formed respectively by the plurality of image forming units, being transferred to the recording medium so as to form an image;

wherein a pair of recording medium feed speed detection means are provided upstream and downstream of the image transfer region, respectively, and there is provided image-forming position correction amount-outputting means for correcting a misregistration of the image recording position in the feed direction at the region in accordance with the speed detected by the recording medium feed speed detection means.

The latent image-forming means is preferable to include means for correcting a latent image-forming timing in accordance with a correction amount outputted from the correction amount-outputting means.

The latent image-forming means is preferable to include means for correcting a latent image-forming position in accordance with a correction amount outputted from the correction amount-outputting means.

The transfer means is preferable to include means for correcting a toner image-transferring position in accordance with a correction amount outputted from the correction amount-outputting means.

DESCRIPTION OF THE PREFERRED EMBODIMENTS

A preferred embodiment of the present invention will now be described with reference to the drawings.

Figure 1:
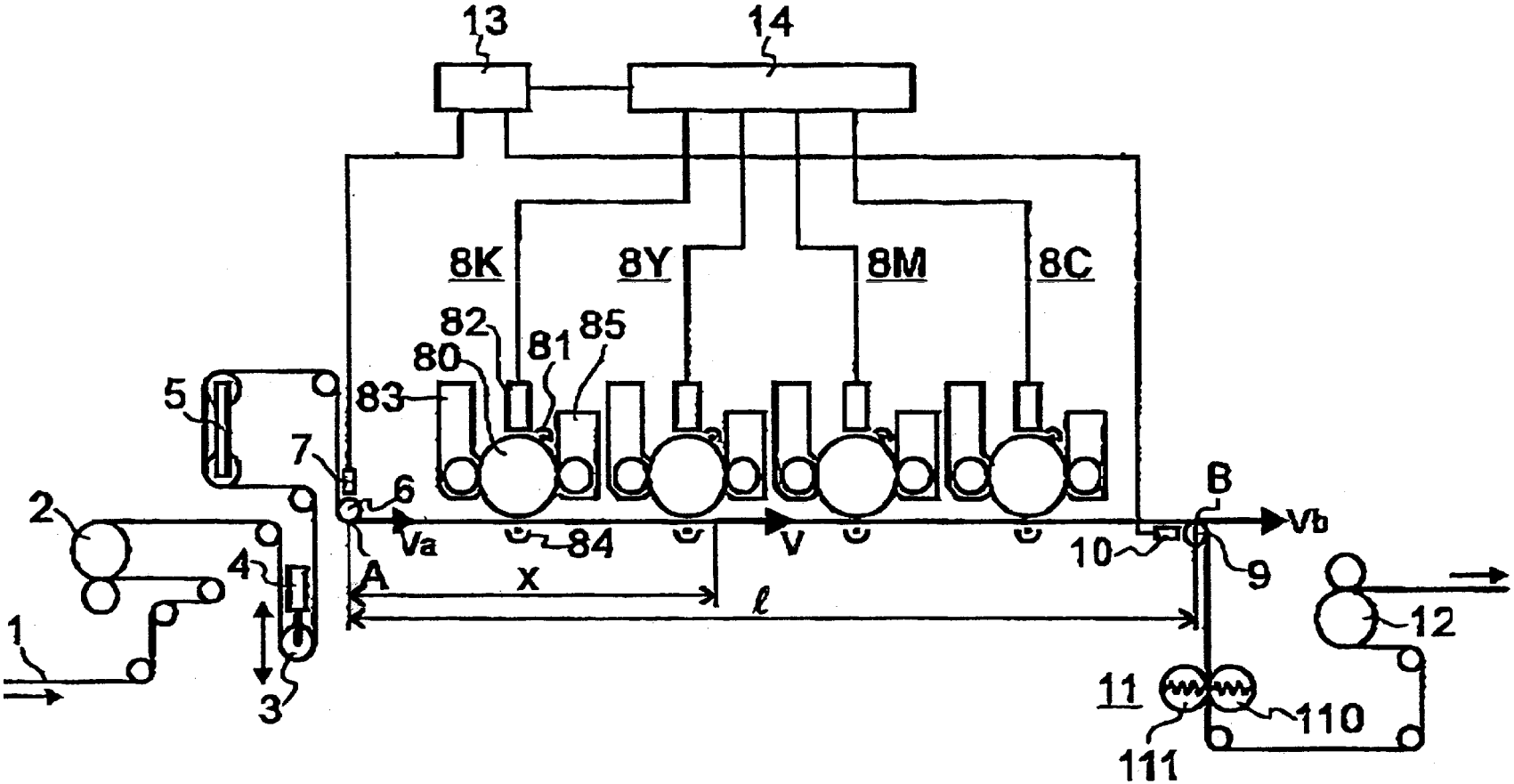
FIG. 1 is a schematic view of the overall construction in accordance with one embodiment of the present invention.

FIG. 1 shows the construction of a tandem-type color image-forming apparatus in accordance with an embodiment of the invention.

In FIG. 1, reference numeral 1 denotes a continuous recording medium made of paper or the like, and reference numeral 2 denotes an in-feed roll for supplying the recording medium 1, and reference numeral 12 denotes an out-feed roll for discharging the recording medium to which an image is fixed. The speed of driving of the in-feed roll 2 is different from that of the out-feed roll 12. More specifically, the in-feed roll 2 is driven at a speed lower than that of the out-feed roll 12, thereby applying a tension to the recording medium 1. Reference numeral 3 denotes a dancer roll which is connected to load control means 4, such as an air cylinder, a spring or a weight, and is translated so as to apply a tension to the recording medium 1.

Reference numeral 5 denotes a edge control mechanism for controlling the position of the recording medium 1 in a direction of the width thereof. The position of the recording medium 1 in the direction of the width thereof is determined by this edge control mechanism 5, and then the recording medium passes through an image forming portion. Reference numeral 11 denotes fixing means in which the recording medium 1, to which the image has been transferred at the image forming portion, is passed between a fixing roll 110 and a backup roll 111, which have heating means, thereby fixing the image to the recording medium 1.

Reference numeral 6 denotes an idle roll provided upstream of the image forming portion. Reference numeral 7 denotes a recording medium feed speed detection means constituted by a rotary encoder. Reference numeral 9 denotes an idle roll provided downstream of the image forming portion. Reference numeral 10 denotes means for detecting the feed speed of the recording medium 1. Reference numeral 13 denotes correction amount-outputting means for outputting a misregistration correction amount in accordance with the feed speed of the recording medium 1 detected by the feed speed detection means 10. The amount of correction of misregistration of the image in the direction of feed of the recording medium 1 is outputted by this correction amount-outputting means 13. Reference numerals 8K, 8Y, 8M and 8C respectively denote image forming units for respectively forming toner images of different colors, that is, K, Y, M and C.

The procedure of forming the single-toner image will be described, for example, with respect to the image forming unit 8K.

First, electric charges are applied onto a photo-sensitive member 80 (serving as an image-carrying member) by an electric charger 81. Then, in response to a signal from image write control means 14, light is applied from latent image-forming means 82, such as a LED or a laser, to the photo-sensitive member 80, and the electric charges are removed from this portion of the photo-sensitive member 80, thereby forming a latent image. Then, a toner is caused to adhere to the latent image by developing means 83, thereby forming a toner image. The thus formed toner image is transferred onto the recording medium 1 by transfer means 84. At this time, those images, which have not been used in this transferring operation, are removed by a cleaner 85.

The other image forming units 8Y, 8M and 8C are identical in construction to the image forming unit 8K, and the images are formed respectively by the four image forming units K, Y, M and C separately from one another, and these images are superimposed upon one another on the recording medium 1, thereby forming a color image. In FIG. 1, although the image forming units are arranged only at one side of the recording medium 1, the image forming units can be arranged on each side of the recording medium 1, in which case the images can be simultaneously formed on the opposite sides of the recording medium 1, respectively.

Figure 2:
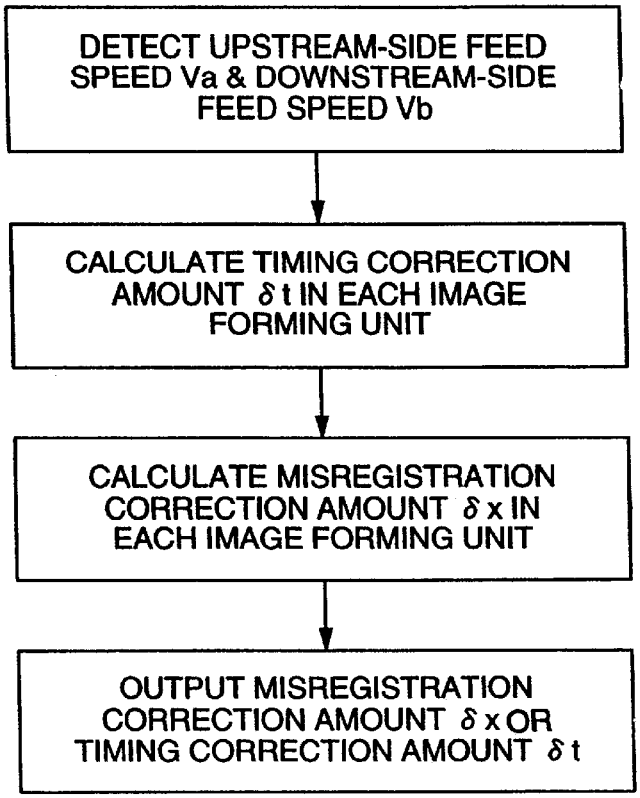
FIG. 2 is a flow chart of a procedure of correcting a color misregistration in accordance with an embodiment of the present invention.

FIG. 2 shows the specific procedure of outputting the image misregistration correction amount.

In FIG. 2, the feed speed Va of the recording medium 1 is detected at an upstream-side feed speed detection point A, and the feed speed Vb is detected at a downstream-side feed speed detection point B. If the distance between the point A and the point B along the recording medium 1 is represented by l, and the distance from the point A to an arbitrary point along the recording medium is represented by x, then the feed speed V at the arbitrary point is expressed by the following formula:

$$V=Va+(Vb-Va)\times(x/l)$$

At this time, the time, required for a point on the recording medium 1 to reach the arbitrary point, is expressed by the following formula:

$$t=l/(Vb-Va)\times\ln[(Vb-Va)/Va\times(x/l)+l]$$

Therefore, when Va is used as a reference, the timing correction amount δt at the arbitrary point is expressed by the following formula:

$$\delta t=t-x/Va$$

By using the above formula with respect to x corresponding to the image transfer point of each of the image forming units 8K, 8Y, 8M and 8C, each image-forming timing correction amount can be obtained.

Further, an image-forming position correction amount δx can be obtained from the following formula:

$$\delta x=V\times\delta t$$

When a detection error of the speed detection means becomes a problem, the influence of the error can be reduced by averaging the detected speed at predetermined time intervals since generally, a fluctuation cycle of a tension, acting on the recording medium, is sufficiently larger as compared with the sampling interval of the speed detection means.

Although the downstream-side speed detection means 10 is mounted on the idle roll 9 as shown in FIG. 1, it does not always need to be provided at this position, and this speed detection means 10 may be mounted on the fixing roll 110 or the backup roll 111 of the fixing means 11.

Similarly, although the upstream-side and downstream-side speed detection means 7 and 10 are mounted respectively on the idle rolls 6 and 9 as shown in FIG. 1, non-contact-type speed detection means, such as a laser velocimetry, can be used.

Although the fixing means 11 is constituted by the fixing roll and the backup roll as shown in FIG. 1, it may be replaced by non-contact-type heating means.

Although the photo-sensitive member 80, serving as the image-carrying member, is provided as a drum as shown in FIG. 1, it may be constituted using a photo-sensitive belt extended around a plurality of rollers.

Then, the time correction amount δt, calculated by the above procedure, is fed to the image write control means 14, and the timing of outputting an image write signal to the latent image-forming means 82 is controlled.

Figure 3:
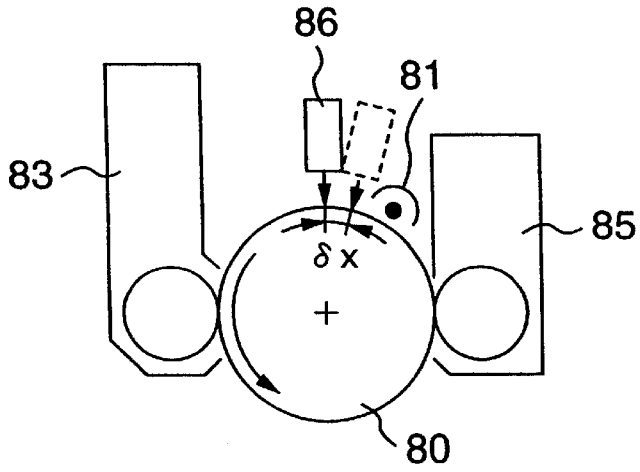
FIG. 3 is a schematic view of latent image-forming position correction means in accordance with another embodiment of the present invention.

FIG. 3 is a schematic view of image transfer position correction means in accordance with another embodiment.

In FIG. 3, an LED is used as latent image-forming means, and the position of the LED 86 is moved by LED support means (not shown), thereby moving the latent image-forming position by an amount corresponding to the position correction amount δx calculated according to the above procedure.

Figure 4:
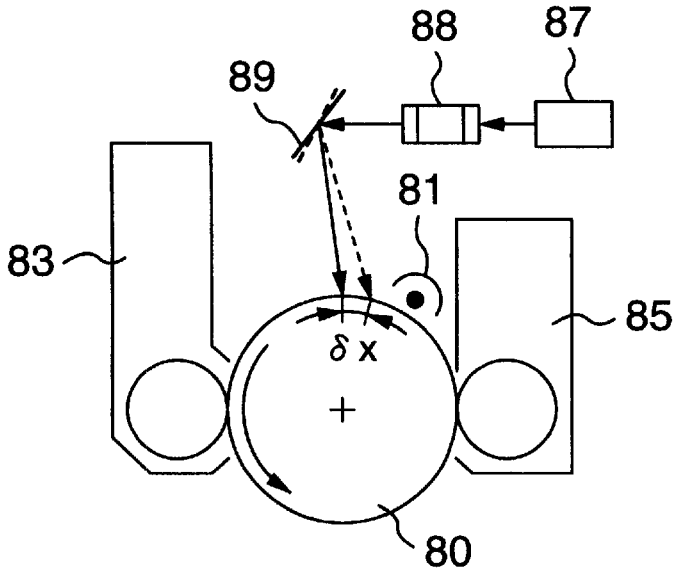
FIG. 4 is a schematic view of latent image-forming position correction means in accordance with a further embodiment of the present invention.

FIG. 4 is a schematic view of image transfer position correction means in accordance with a further embodiment.

In FIG. 4, a laser is used as latent image-forming means, and a ray of light, emitted from the laser 87, is distributed in a main scanning direction by a rotating polygon mirror 88, and is further applied onto the surface of the photo-sensitive member 80 through a reflection mirror 89. At this time, the angle of the reflection mirror 89 is changed by reflection mirror support means (not shown), thereby moving the latent image-forming position by an amount corresponding to the position correction amount δx calculated according to the above procedure.

Each of the image forming units 8K, 8Y, 8M and 8C may be moved by an amount corresponding to the position correction amount δx calculated according to the above procedure, thereby moving the toner image transfer position.

Figure 5:
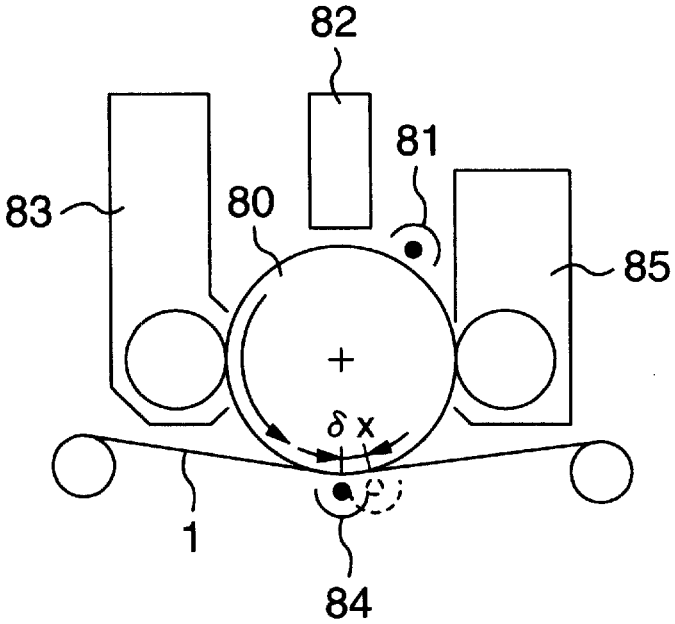
FIG. 5 is a schematic view of image transfer position correction means in accordance with a further embodiment of the present invention.

FIG. 5 is a schematic view of image transfer position correction means in accordance with a further embodiment.

In FIG. 5, in the case where there is adopted a structure in which the recording medium is wound tight around the photo-sensitive member at the transfer portion, the toner image transfer position may be moved by moving the transfer means 84 by an amount corresponding to the position correction amount δx calculated according to the above procedure.

As described above, according to the present invention, the pair of recording medium speed detection devices are provided upstream and downstream of the image forming section, respectively, and there is provided the means for calculating the image misregistration correction amount from the detected recording medium feed speed, and with this construction, the color misregistration due to the elongation and fluctuation of the continuous recording medium is corrected.

Therefore, the color misregistration due to the elongation and fluctuation of the continuous recording medium is reduced at the relatively-low cost while effectively using the continuous recording medium, so that the image of high quality can be formed.

According to the present invention, there can be provided the image forming apparatus in which the position deviation of the recording medium can be detected highly precisely without the use of registration marks and a high-precision sensor.

What is claimed is:

1. An image forming apparatus comprising:

a plurality of image forming units each including latent image-forming means for forming a latent image on an image-carrying member, developing means for causing a toner to adhere to said latent image, and transfer means for transferring said toner onto a continuous recording medium; and recording medium feed means for feeding said recording medium;

wherein toner images, formed respectively by said plurality of image forming units, are transferred to said recording medium so as to form an image; and wherein a pair of recording medium feed speed detection means are provided upstream and downstream of an image transfer region, respectively, and there is provided image-forming position correction amount-outputting means for correcting a misregistration of an image recording position in the feed direction at said image transfer region in accordance with the speed detected by at least one of said pair of said recording medium feed speed detection means.

2. An image forming apparatus according to claim 1, in which said latent image-forming means includes means for correcting a latent image-forming timing in accordance with a correction amount outputted from said correction amount-outputting means.

3. An image forming apparatus according to claim 1, in which said latent image-forming means includes means for correcting a latent image-forming position in accordance with a correction amount outputted from said correction amount-outputting means.

4. An image forming apparatus according to claim 1, in which said transfer means includes means for correcting a toner image-transferring position in accordance with a correction amount outputted from said correction amount-outputting means.

* * * * *